US005875762A

United States Patent [19]

Tsuchiya et al.

[11] Patent Number: 5,875,762

[45] Date of Patent: Mar. 2, 1999

[54] ENGINE CONTROLLER

[75] Inventors: Kenichi Tsuchiya, Hyogo; Shiro Yonezawa, Tokyo; Hirofumi Ohuchi, Tokyo; Tadashi Tubakiji, Tokyo, all of Japan

[73] Assignee: Mitsubishi Denki Kabushiki Kaisha, Tokyo, Japan

[21] Appl. No.: 17,690

[22] Filed: Feb. 3, 1998

[30] Foreign Application Priority Data

Oct. 2, 1997 [JP] Japan ..... 9-269596

[51] Int. Cl.[6] ..... F02D 41/08; F02M 3/07

[52] U.S. Cl. ..... 123/399; 123/339.25

[58] Field of Search ..... 123/339.25, 399

[56] References Cited

U.S. PATENT DOCUMENTS

| | | | |
|---|---|---|---|
| 5,415,144 | 5/1995 | Hardin et al. | 123/399 |
| 5,447,134 | 9/1995 | Yokoyama | 123/399 |
| 5,492,095 | 2/1996 | Hara et al. | 123/399 |
| 5,560,335 | 10/1996 | Bellon et al. | 123/399 |
| 5,566,656 | 10/1996 | Buchl | 123/399 |
| 5,746,178 | 5/1998 | Susaki et al. | 123/399 |

FOREIGN PATENT DOCUMENTS 6-101550 4/1994 Japan .

*Primary Examiner*—Erick R. Solis

*Attorney, Agent, or Firm*—Sughrue, Mion, Zinn, Macpeak & Seas, PLLC

[57] ABSTRACT

An engine controller includes various sensors for detecting a degree of throttle opening θ and a degree of accelerator opening α and a control unit 5 for determining the control amount θc of a throttle actuator 1 from operating states, the control unit includes an A/D converter 70 for A/D converting respective degrees of opening at a predetermined resolving power, means 71 for calculating a target degree of throttle opening θ1 at a resolving power higher than the predetermined resolving power, means 72 for calculating a target degree of throttle opening θ2 at the predetermined resolving power in accordance with the target degree of throttle opening θ1 and means 73 for calculating a control amount in accordance with the target degree of throttle opening θ2, the target degree of throttle opening θ2 includes two points which are determined by the predetermined resolving power and control amount calculation means repeatedly controls the throttle actuator at a predetermined cycle using the target degree of throttle opening θ2 as the control amount under predetermined operating conditions. With this arrangement, the engine controller having a high speed and a pinpoint accuracy can be provided at a less expensive cost without using an expensive A/D converter.

12 Claims, 5 Drawing Sheets

ENGINE CONTROLLER

BACKGROUND OF THE INVENTION

1. Field of the Invention

The present invention relates to an engine controller for carrying out throttle control at a high speed with a pinpoint accuracy using a throttle actuator, and more specifically, to an engine controller for improving a substantial throttle control resolving power using a less expensive A/D converter having a low resolving power without particularly using an expensive A/D converter having a high resolving power.

2. Description of the Related Art

Conventionally, a throttle valve acting as an output regulating restricter is mechanically associated with an accelerator in ordinary automobile engines and the degree of opening of the throttle valve is controlled by linking it with the accelerator through a wire or the like.

On the other hand, recently, attention is paid to electronic throttle actuators for driving a throttle valve by a motor. Devices using the throttle actuator detect an amount of depression of an accelerator pedal (degree of accelerator opening) as an electric signal by a degree of accelerator opening sensor, determine a target degree of throttle opening from the degree of accelerator opening through predetermined calculation and supply a control amount corresponding to the target degree of throttle opening to the throttle actuator to thereby control the opening/closing of the throttle valve.

Since this type of the electronic throttle actuators can realize a high engine control capability as well as improve the safety of automobiles, they are used to automobile traction control, constant speed traveling control, idle speed control (generally, referred to as ISC) and so on.

For example, the ISC (idle speed control) which is typical in engine control is disclosed in Japanese Unexamined Patent Publication No. 63-49112. In this case, an idle rotation speed is controlled to a predetermined speed in accordance with a water temperature and an electric load by regulating an amount of air flowing through a bypass.

That is, the apparatus disclosed in the publication disposes the bypass which bypasses a throttle valve to a throttle chamber and regulates the area of the bypass by an actuator to thereby regulate the amount of air flowing through the bypass. The apparatus also realizes a first idle function by disposing an air regulator to the bypass.

However, a cost is increased in this type of the apparatus because auxiliary devices such as the bypass, its flow amount control means and so on are required.

To cope with the above problem, there is proposed a method of realizing the ISC and first idle control functions by improving a control resolving power in idle operation as disclosed in, for example, Japanese Unexamined Patent Publication No. 6-101550.

The apparatus disclosed in the publication feeds back a degree of throttle opening by comparing it with a target degree of throttle opening by amplifying the gain of a degree of throttle opening sensor in the low opening region thereof which detects the degree of opening of a throttle actuator.

Conventionally, when the ISC is carried out using the electronic throttle actuator, since it is required to control an engine speed with a pinpoint accuracy, a resolving power in the control of the degree of throttle opening is a problem. This is because that since the throttle valve is designed to cause an automobile engine to generate a maximum output when it is entirely opened (a passage area is maximized), a control amount corresponding to a maximum flow amount when the throttle valve is entirely opened must be calculated as well as a control amount corresponding to a fine degree of throttle opening must be also calculated when a small amount of air flow is controlled in the ISC.

Therefore, the ISC having a pinpoint accuracy can be realized by the throttle actuator based on a control amount calculated by amplifying the gain of a signal detected by the degree of throttle opening sensor in a low opening region and improving a calculation control accuracy in a region where an amount of air flow is small in the ISC.

In this case, however, since the throttle control accuracy is improved using the degree of throttle opening sensor which has the high gain only in the SIC region as described above, the high accuracy region is narrow and a special electronic device must be added to amplify the gain, by which a cost is also increased a circuit is made complex.

Further, recently, although a high accuracy is required not only in the region where an amount of air flow is small but also in an entire region as the use of the throttle actuator, controllability in the region where an amount of air flow is large cannot be improved in, for example, the traction control, the constant speed control and the like.

As described above, conventional engine controllers have a problem that a cost is increased because the apparatus disclosed in, for example, Japanese Unexamined Patent Publication No. 63-49112 must be provided with the bypass, the flow control means thereof and the like across the throttle valve.

Further, the apparatus disclosed, for example, Japanese Unexamined Patent Publication No. 6-101550 also has a problem that a cost is also increased because the circuit device for amplifying the low level signal from the degree of throttle opening sensor to realize the control and calculation of the high resolving power in the region where the degree of throttle opening is small.

An object of the present invention made to solve the above problems is to provide a high speed engine controller having a pinpoint accuracy at a low cost without using an expensive A/D converter having a high resolving power in the control of a throttle actuator which does not use a bypass.

SUMMARY OF THE INVENTION

An engine controller according to the present invention comprises a throttle actuator for electrically regulating a degree of throttle opening for determining the amount of intake air of an engine; various sensors for detecting the operating states of the engine including the degree of throttle opening and a degree of accelerator opening; and a throttle control unit for determining the control amount of the throttle actuator based on the operating states, wherein the throttle control unit comprises an A/D converter for converting the degree of throttle opening and the degree of accelerator opening into digital signals at a predetermined resolving power; first calculation means for calculating a first target degree of throttle opening at a first resolving power higher than the predetermined resolving power; second calculation means for calculating a second target degree of throttle opening at a second resolving power equal to the predetermined resolving power in accordance with the first target degree of throttle opening; and control amount calculation means for calculating the control amount in accordance with the operating states and the first and second target degrees of throttle opening, the second target degree of throttle opening includes two points determined at the second resolving power; and the control amount calculation means repeatedly controls the throttle actuator at a predetermined cycle using the second target degree of throttle opening as the control amount when the operating states satisfy predetermined conditions.

When the first target degree of throttle opening is not equal to the second target degree of throttle opening, the control amount calculation means of the engine controller according to the present invention repeats the control amount at the two points which are located across the first target degree of throttle opening and determined at the second resolving power at a predetermined cycle.

When the first target degree of throttle opening is equal to the second target degree of throttle opening, the control amount calculation means of the engine controller according to the present invention repeats the control amount at the two points which are located across the first target degree of throttle opening and determined by the second resolving power at a predetermined cycle.

When the first target degree of throttle opening is equal to the second target degree of throttle opening, the control amount calculation means of the engine controller according to the present invention prohibits the repetition of the control and causes the control amount to coincide with the first target degree of throttle opening.

The predetermined cycle of the engine controller according to the present invention is set longer than the response time of the throttle actuator as well as shorter than one half the delay time of the intake air of the engine.

In the engine controller according to the present invention, the ratio at which the control amount is repeated at the two points which are located across the first target degree of throttle opening in accordance with the second target degree of throttle opening is set by the function of the remainder obtained by subtracting the second target degree of throttle opening from the first target degree of throttle opening.

In the engine controller according to the present invention, the ratio at which the control amount is repeated at the two points across the first target degree of throttle opening in accordance with the second target degree of throttle opening is set to 1:1.

The throttle control unit of the engine controller according to the present invention includes operating state discrimination means for discriminating an ordinary operating state and predetermined operating states in accordance with the above operating states; the first calculation means prohibits the calculation of the first target degree of throttle opening when the ordinary operating state is discriminated and calculates the first target degree of throttle opening in accordance with the degree of accelerator opening when the predetermined operating states are discriminated; and the second calculation means calculates the second target degree of throttle opening in accordance with the degree of accelerator opening when the ordinary operating state is discriminated and calculates the second target degree of throttle opening in accordance with the first target degree of throttle opening when the predetermined operating states are discriminated.

The various sensors of the engine controller according to the present invention include idle detection means and the operating state discrimination means discriminates an idle operating state based on a detection signal from the idle detection means as one of the predetermined operating states.

The various sensors of the engine controller according to the present invention include wheel slip detection means and the operating state discrimination means discriminates a wheel slip state based on a detection signal from the idle detection means as one of the predetermined operating states.

The various sensors of the engine controller according to the present invention include constant speed travel detection means and the operating state discrimination means discriminates a constant speed traveling state based on a detection signal from the idle detection means as one of the predetermined operating states.

The various sensors of the engine controller according to the present invention include first idle detection means and the operating state discrimination means discriminates a first idle operating state based on a detection signal from the idle detection means as one of the predetermined operating states.

DESCRIPTION OF THE PREFERRED EMBODIMENTS

Embodiment 1

Figure 1:
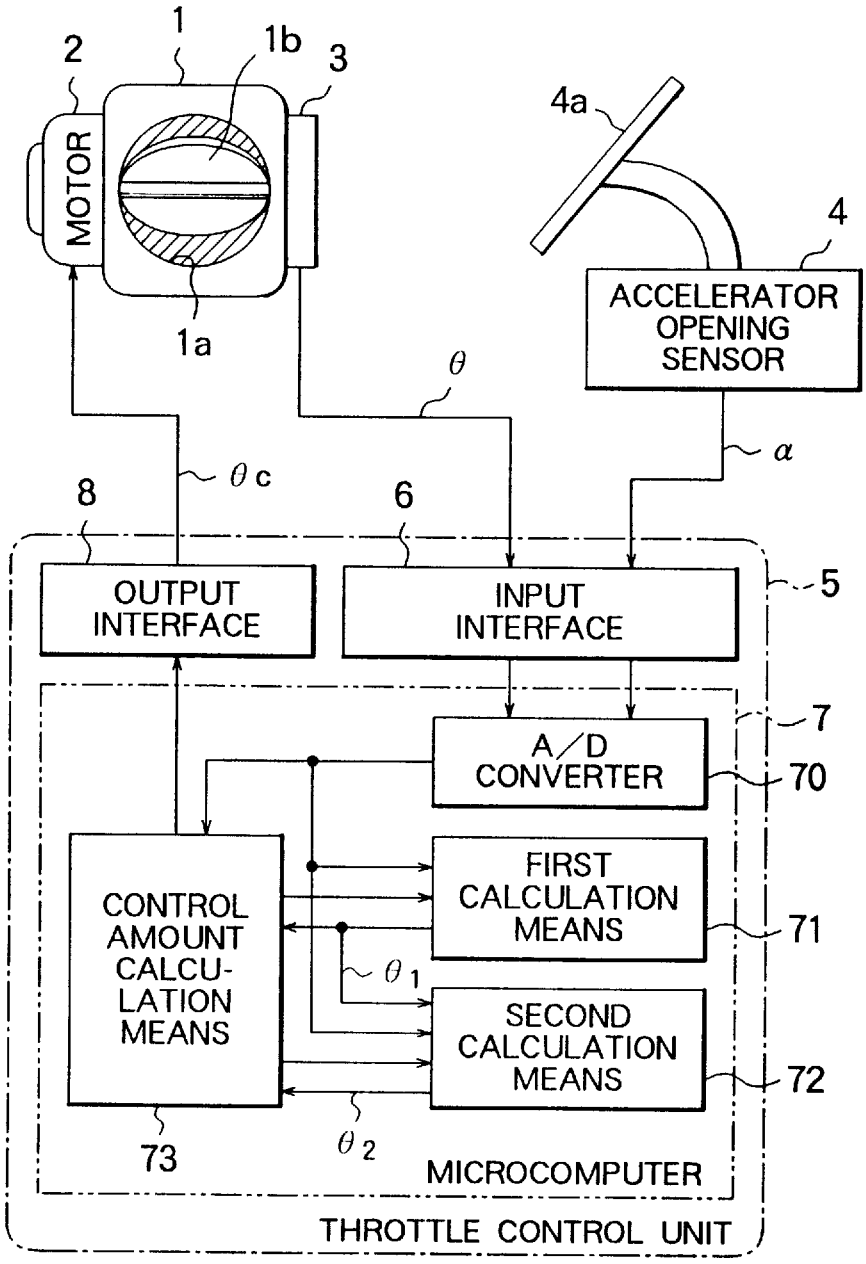
FIG. 1 is a block diagram showing the arrangement of the main portion of an embodiment 1 of the present invention.

An embodiment 1 of the present invention will be described below with reference to FIG. 1. FIG. 1 is a block diagram showing the arrangement of the main portion of the embodiment 1 of the present invention and shows only a throttle controller and sensors relating to it.

In FIG. 1, a throttle actuator 1 for regulating the amount of intake air of an engine (not shown) includes a throttle valve 1*b* for regulating the area of the passage of a suction pipe 1*a*, a motor 2 for driving the throttle valve 1*b* and a degree of throttle opening sensor 3 for detecting the amount of drive, that is, the degree of throttle opening $\theta$ of the throttle valve 1*b*.

The degree of throttle opening sensor 3 linearly detects the degree of throttle opening $\theta$.

A degree of accelerator opening sensor 4 linearly detects the amount of depression of an accelerator pedal 4*a* depressed by the operator, that is, a degree of accelerator opening $\alpha$.

Although not shown, there are provided various sensors for detecting various types of information indicating the operating state of the engine when necessary in addition to the degree of throttle opening sensor 3 and the degree of accelerator opening sensor 4.

A throttle control unit 5 composed of an ECU (electronic control unit) includes an input I/F (input interface) 6 for capturing various types of sensor information, a microcomputer 7 for unifying the process in the throttle control unit 5 and an output I/F (output interface) 8 for creating the control amount $\theta c$ to the motor 2.

The input I/F 6 is supplied with various types of information from the various sensors in addition to the degree of throttle opening $\theta$ and the degree of accelerator opening $\alpha$.

The output I/F 8 outputs the control amount θ*c* based on a second target degree of throttle opening θ2 to the motor 2 as a drive signal.

The microcomputer 7 includes an A/D converter 70 for A/D converting detected information such as the degree of throttle opening θ and so on, a first calculation means 71 for calculating a first target degree of throttle opening θ1 of a pinpoint accuracy based on the various types of the sensor information such as the degree of accelerator opening α1, a second calculation means 72 for calculating the second target degree of throttle opening θ2 for actually driving the throttle valve 1*b* based on the first target degree of throttle opening θ1 and control amount calculation means 73 for calculating the control amount θ*c* based on the various types of sensor information, the second target degree of throttle opening θ2 and so on.

The A/D converter 70 converts, for example, the degree of throttle opening θ and the degree of accelerator opening α into digital signals at a predetermined resolving power.

The first calculation means 71 calculates the first target degree of throttle opening θ1 at a first resolving power d1 which is higher than the predetermined resolving power in the A/D converter 70.

The second calculation means 72 calculate the second target degree of throttle opening θ2 at a second resolving power d2 which is equal to the predetermined resolving power in the A/D converter 70 in accordance with the first target degree of throttle opening θ1.

The second target degree of throttle opening θ2 includes the values at two points of an H (high) level and an L (low) level which are determined by the second resolving power d2 to repeatedly control the throttle actuator 1 (usually, referred to as a dither control).

The control amount calculation means 73 calculates the control amount θ*c* in accordance with the various types of operating states and the first and second target degrees of throttle opening θ1 and θ2 as well as repeatedly controls the throttle actuator 1 at a predetermined cycle when the operating states satisfy predetermined conditions using the second target degree of throttle opening θ2 as the control amount θ*c*.

Next, operation of the embodiment 1 of the present invention will be described with reference to FIG. 2 and FIG. 3.

Figure 2:
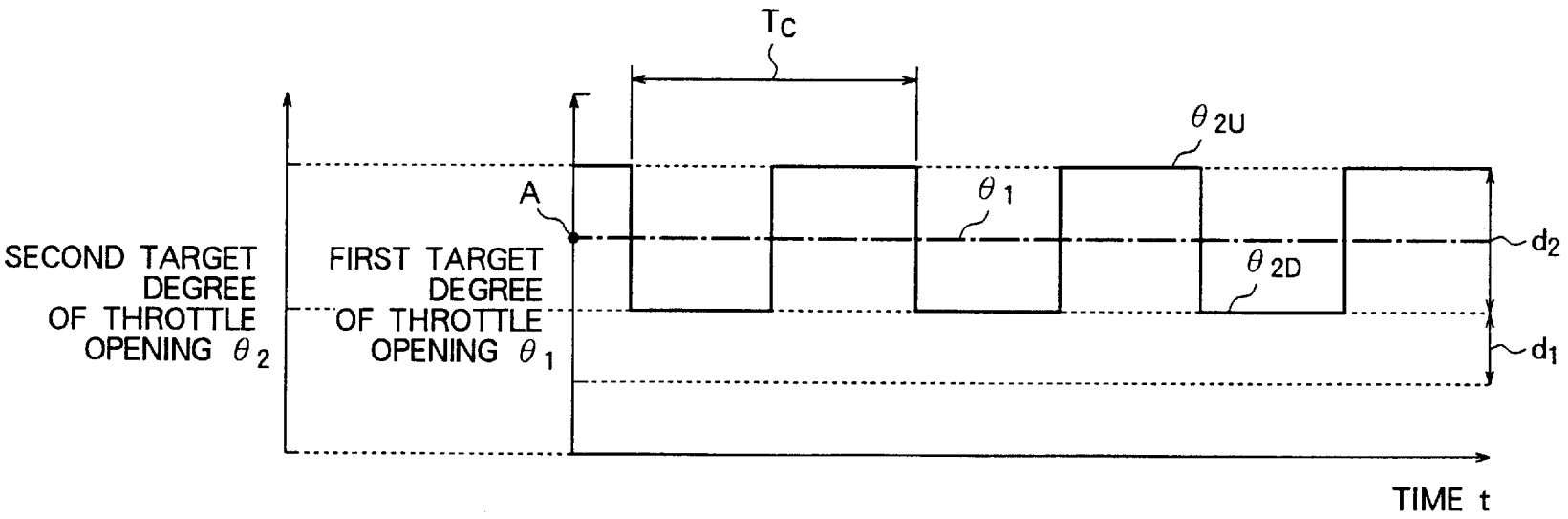
FIG. 2 is a waveform view showing the repeated operation of a second target degree of throttle opening by the embodiment 1 of the present invention.
Figure 3:
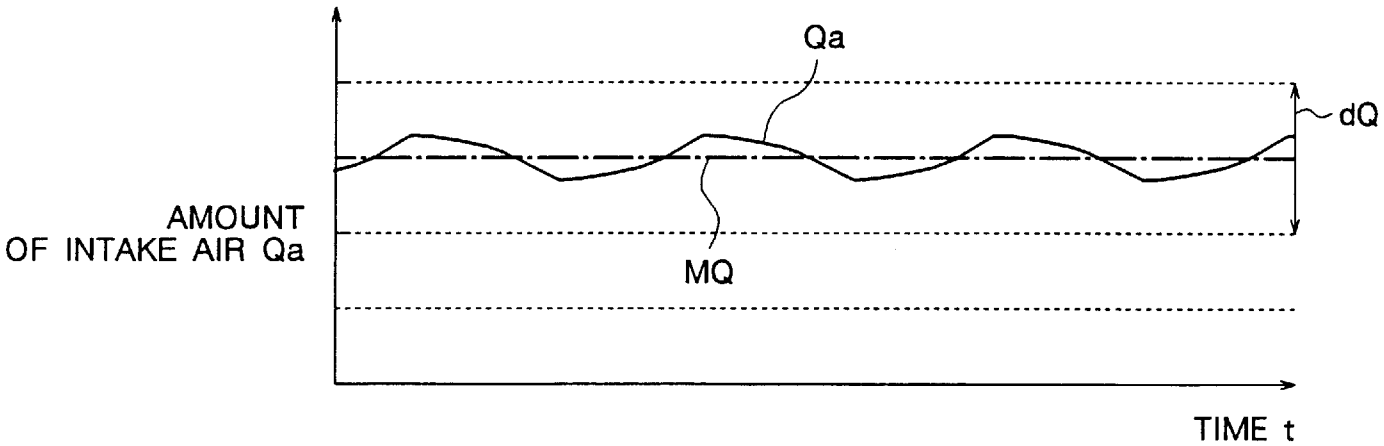
FIG. 3 is a waveform view showing the control operation of an amount of intake air by the embodiment 1 of the present invention.

FIG. 2 and FIG. 3 are waveform views showing operation when an amount of intake air Q*a* is actually controlled by the embodiment 1 of the present invention.

First, the sensor information such as the degree of throttle opening θ and the degree of accelerator opening a is input to the respective calculation means 71 to 73 in the microcomputer 7 through the A/D converter 70.

The various types of the sensor information includes, for example, an engine speed based on a crank angle signal and so on.

The first calculation means 71 calculates the first target degree of throttle opening θ1 of the pinpoint accuracy at the first resolving power d1 from the various types of sensor information and the second calculation means 72 calculates the second target degree of throttle opening θ2 at the second resolving power d2 from the first target degree of throttle opening θ1.

The second target degree of throttle opening θ2 having the same accuracy as that of the A/D converter 70 is calculated in comparison with the actual degree of throttle opening θ by the control amount calculation means 73 and the control amount θ*c* as the result of calculation is supplied to the throttle actuator 1 as a drive signal. With this operation, the degree of throttle opening θ of the throttle actuator 1 is subjected to feedback control.

In FIG. 2, the abscissa represents time t and the ordinate represents the first target degree of throttle opening θ1 and the second target degree of throttle opening θ2.

The first target degree of throttle opening θ1 is calculated at the resolving power d1 which is twice that of the A/D converter 70 and the second target degree of throttle opening θ2 is calculated at the resolving power d2 which is equal to that of the A/D converter 70.

Therefore, as shown in FIG. 2, the minimum resolving power d1 of the first calculation means 71 is one half the minimum resolving power d2 of the A/D converter 70 and the second calculation means 72.

For example, since a point A which can be controlled by the first target degree of throttle opening θ1 is located intermediately of the respective points which can be controlled by the second target degree of throttle opening θ2, it cannot be calculated by the second calculation means 72.

When the first target degree of throttle opening θ1 is located at the point A, the point A cannot be controlled by the second target degree of throttle opening θ2.

Therefore, the control amount calculation means 73 generates the control amount θ*c* in repetition in accordance with the second target degree of throttle opening θ2 as shown in FIG. 2.

That is, control is carried out so as to repeat the degrees of opening θ2U and θ2D of upper and lower two points which are located above and below the point A calculated as the first target degree of throttle opening θ1 and represented by the resolving power d2 of the second target degree of throttle opening θ2.

At the time, a predetermined control cycle Tc at which the second target degree of throttle opening θ2 is repeated is determined by a delay time (which is determined by the capacity of an intake manifold and so on) until air is actually sucked into the engine.

Further, since there is usually a delay time of about 200 msec. until the air sucked into the engine is actually output as torque, when it is assumed that a degree of surplus is represented by ΔT, the control cycle Tc is determined by the following formula (1).

$$Tc=200[\text{msec}]/2-\Delta T \ldots \quad (1)$$

It can be found from the formula (1) that the control cycle Tc is preferably set to about 80 msec.

FIG. 3 is a waveform view showing operation of the amount of intake air Q*a* when the throttle actuator 1 is driven in accordance with the second target degree of throttle opening θ2 and corresponds to the waveform view of FIG. 2.

In FIG. 3, the abscissa represent time t and the ordinate represents the amount of intake air Q*a*.

As apparent from FIG. 3, since an average amount of intake air MQ which is determined by averaging the repeated variation of the amount of intake air Q*a* is controlled within the range of a pinpoint accuracy which is smaller than the minimum control resolving power dQ of the amount of intake air Q*a* when it is controlled at the minimum resolving power d2 of the second target degree of throttle opening θ2, the average amount of intake air MQ is controlled to a target amount of intake air.

As described above, the actual amount of intake air Q*a* can be also controlled with a pinpoint accuracy by calculating the first target degree of throttle opening θ1 of the pinpoint accuracy and controlling the second target degree of throttle opening θ2 so that it is as large as the first target degree of throttle opening θ1 in average.

Therefore, the ISC (traction control, constant speed traveling control, etc.) can be carried out with a pinpoint accuracy.

That is, the control resolving power dl corresponding to the first target degree of throttle opening θ1 can be realized by calculating the second target degree of throttle opening θ2 which is alternately changed at the two points across the first target degree of throttle opening θ1 at the predetermined control cycle Tc and controlling the degree of throttle opening θ by the control amount θ*c* which corresponds to the second target degree of throttle opening θ2.

Since the control of the pinpoint accuracy can be realized by the respective control means 71 to 73 in the throttle control unit 5, no ISC bypass and gain amplifying circuit device need not be provided. Thus, a system having a pinpoint accuracy can be realized at a low cost.

Further, since the predetermined cycle Tc for repeating the control amount θ*c* is set longer than the response time of the of the throttle actuator 1 and shorter than one half the delay time of the engine intake air, the amount of intake air Q*a* is not almost affected by the repeated control at the time when air is actually sucked into the engine, by which an averaged intake air is supplied to the engine.

Embodiment 2

Note, although conditions for repeating the control amount θ*c* are not described in the above embodiment 1, when the first target degree of throttle opening θ1 is not equal to the second target degree of throttle opening θ2, the control amount calculation means 73 may repeat the control amount θ*c* at the two points which are located across the first target degree of throttle opening θ1 and determined by the second resolving power d2.

In this case, the amount of intake air Q*a* can be controlled with a pinpoint accuracy which corresponds to the first resolving power d1 by the average amount of intake air MQ as shown in FIG. 3.

Embodiment 3

Even if the first target degree of throttle opening θ1 is equal to the second target degree of throttle opening θ2, the control amount calculation means 73 may repeat the control amount θ*c* at the two points which are located across the first target degree of throttle opening θ1 and determined by the second resolving power d2.

In this case, since even the target degree of throttle opening which can be controlled by the second resolving power d2 can be prevented from being not controlled due to a dead zone by positively repeating the control amount θ*c* (the dither control), the throttle actuator 1 can be securely controlled to the target degree of opening.

Further, since the throttle valve 1*b* is rotated and vibrated without being stopped, rotational operability can be always stabilized by preventing the deterioration of operability due to the increase of the friction force of a rotary shaft.

Embodiment 4

When the first target degree of throttle opening θ1 is equal to the second target degree of throttle opening θ2, the control amount calculation means 73 may cause the control amount θ*c* to coincide with the first target degree of throttle opening θ1 by prohibiting the repeated control.

In this case, since the control amount θ*c* is fixed to a value corresponding to the first target degree of throttle opening θ1, power consumption can be reduced by eliminating unnecessary rotational operation although there is a possibility that the dead zone may be generated.

Embodiment 5

Note, although the above embodiment 1 does not particularly refer to the ratio at which the control amount θ*c* occupies the two points when it is repeated, the ratio of repetition may be set in accordance with the relationship between the first target degree of throttle opening θ1 and the second target degree of throttle opening θ2.

For example, when the first target degree of throttle opening θ1 is different from the second target degree of throttle opening θ2, the ratio at which the control amount θ*c* (second target degree of throttle opening θ2) is repeated at the two points across the first target degree of throttle opening θ1 is set by the function of the remainder which is obtained by subtracting the second target degree of throttle opening θ2 from the first target degree of throttle opening θ1.

That is, the second target degree of throttle opening θ2 is repeated centering around the first target degree of throttle opening θ1 at the predetermined cycle Tc in FIG. 2. However, even if the first target degree of throttle opening θ1 is not located at the center of the second target degree of throttle opening θ2, the degree of throttle opening θ corresponding to the first target degree of throttle opening θ1 can be obtained by changing the ratio at which the second target degree of throttle opening θ2 is repeatedly switched.

When the first target degree of throttle opening θ1 is equal to the second target degree of throttle opening θ2, the ratio of the control amount θ*c* (second target degree of throttle opening θ2) which is repeated at the two points across the first target degree of throttle opening θ1 is set to 1:1.

With this arrangement, the degree of throttle opening θ of the throttle actuator 1 can be controlled to the target degree of opening with a pinpoint accuracy.

Embodiment 6

Note, although description is made in the above embodiment 1 by exclusively paying attention to the ISC, the control amount θ*c* may be selectively repeated in accordance with various types of operating conditions.

Figure 4:
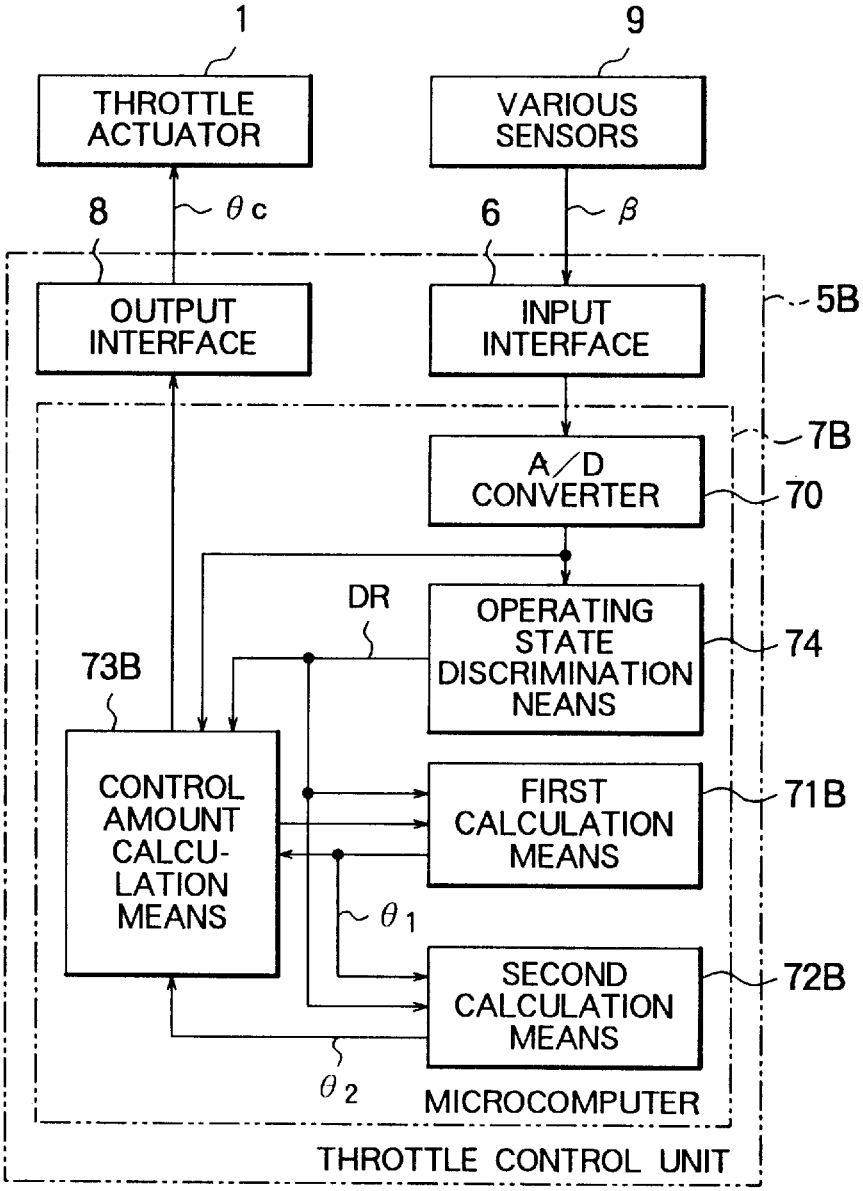
FIG. 4 is a block diagram showing the main portion of a embodiment 2 of the present invention.

FIG. 4 is a block diagram showing the main portion of an embodiment 6 of the present invention, wherein the same components as those described above are denoted by the same numerals and the detailed description thereof is omitted.

A throttle control unit 5B, a microcomputer 7B and respective calculation means 71B–73B correspond to the aforesaid throttle control unit 5, microcomputer 7 and respective calculation means 71–73, respectively.

In this case, various sensors 9 include an idle sensor, a slip state sensor, a constant speed travel sensor and a first address sensor (all of them are not shown) in addition to the degree of throttle opening sensor 3 and the degree of accelerator opening sensor 4.

For example, the idle sensor is composed of an idle switch and so on and the operation signal of the idle switch serves as an idle operating state detection signal.

The slip state sensor is composed of a wheel speed sensor and so on and the wheel speed information from the wheel speed sensor serves as a front and rear wheel slip state detection signal.

The constant speed travel sensor is composed of a constant speed travel switch and so on and the operation signal of the constant speed travel switch serves as a constant speed traveling state detection signal.

Further, the first idle sensor is composed of a temperature sensor and so on and temperature information of engine cooling water, engine cooling oil and so on serves as a first idle state detection signal.

The microcomputer 7B in the throttle control unit 5B includes operating state discrimination means 74 interposed between the A/D converter 70 and the respective calculation means 71B–73B.

The operating state discrimination means 74 discriminates an ordinary operating state and predetermined operating states in accordance with the operating state information β from the various sensors 9 and outputs a discrimination signal DR to the respective calculation means 71B–73B.

When the discrimination signal DR indicates the ordinary operating state, the first calculation means 71B prohibits the calculation of the first target degree of throttle opening θ1, whereas when the discrimination signal DR indicates the predetermined operating states, the first calculation means 71B calculates the first target degree of throttle opening θ1 in accordance with, for example, the degree of accelerator opening α.

When the discrimination signal DR indicates the ordinary operating state, the second calculation means 72B calculates the second target degree of throttle opening θ2 in accordance with the degree of accelerator opening, whereas when the discrimination signal DR indicates the predetermined operating states, the second calculation means 72B calculates the second target degree of throttle opening θ2 in accordance with the first target degree of throttle opening θ1.

The operating state discrimination means 74 discriminates the idle operating state based on the detection signal (the idle switch operation signal) from the idle sensor, the wheel slip state based on the detection signal from the wheel speed sensor, the constant speed traveling state based on the operation signal from the constant speed travel switch or the first idle operating state based on the detection signal from the first idle detection means as one of the predetermined operating states.

Figure 5:
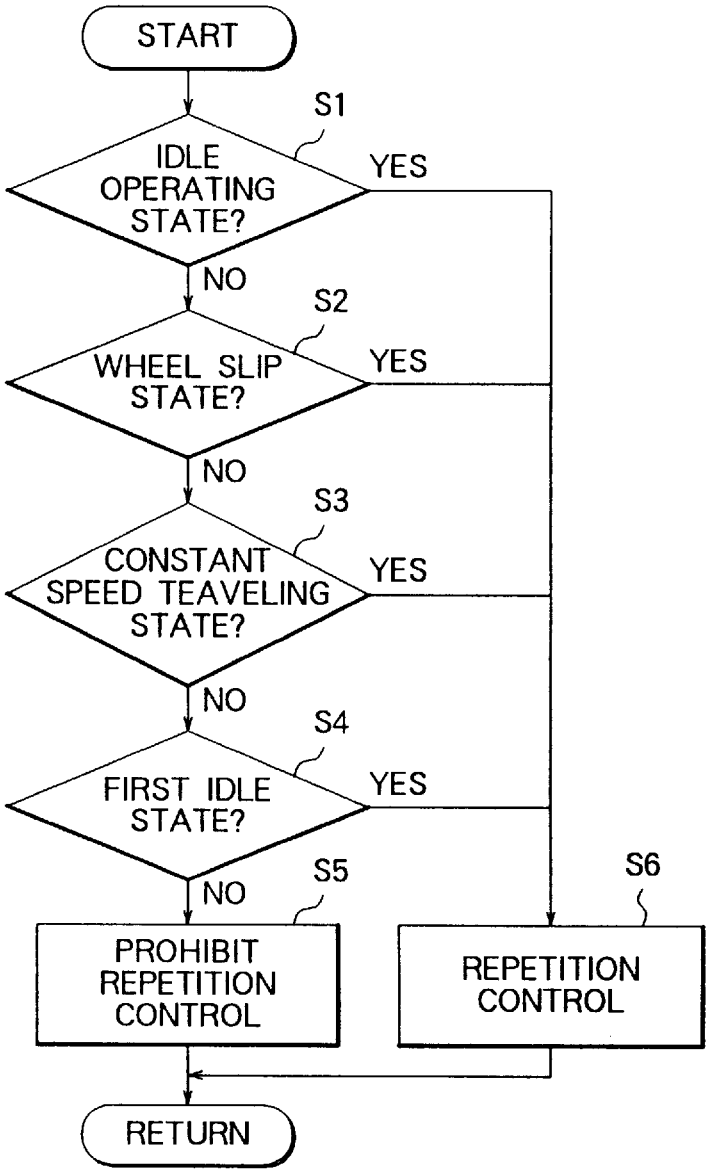
FIG. 5 is a flowchart showing control operation in a predetermined operating state executed by the embodiment 2 of the present invention.

Next, throttle control operation in accordance with the operating state of the embodiment 6 of the present invention shown in FIG. 4 will be described with reference to the flowchart of FIG. 5.

First, the operating state discrimination means 74 discriminates whether the present operating state is the idle operating state or not from the idle switch operation signal and so on included in the information β detected by the various sensors 9 (step S1).

If it is discriminated at step S1 that the present operating state is not the idle operating state (that is, NO), the operating state discrimination means 74 subsequently discriminates whether the present operating state is the wheel slip state or not from the wheel speed included in the information β detected by the various sensors 9 (step S2).

If it is discriminated at step S2 that the present operating state is not the wheel slip state (that is, NO), the operating state discrimination means 74 subsequently discriminates whether the present operating state is the constant speed traveling state or not from the constant speed travel switch operation signal and so on included in the information β detected by the various sensors 9 (step S3).

If it is discriminated at step S3 that the present operating state is not the constant speed traveling state at step S3 (that is, NO), the operating state discrimination means 74 subsequently discriminates whether the present operating state is the first idle state or not from the temperature information and so on included in the information β detected by the various sensors 9 (step S4).

If it is discriminated at step S4 that the present operating state is not the first idle state (that is, NO), a single target degree of opening corresponding to the degree of accelerator opening α from the degree of accelerator opening sensor 4 is set as the control amount θ*c* and the process returns without repeating the control (step S5).

On the other hand, when it is discriminated at any of the steps S1–S4 that the present operating state is one of the operating states (that is, YES), the control amount θ*c* is repeated as described above to thereby improve the control accuracy of the throttle actuator 1 (step S6) and the process returns.

Likewise the above mentioned, although the first target degree of throttle opening θ1 has an accuracy sufficient to carry out the ISC, traction control, constant speed travel control and so on, since the accuracy of the second target degree of throttle opening θ2 is the same as that of the A/D converter 70, it does not have an accuracy sufficient to carry out the ISC, traction control and constant speed travel control. Therefore, the accuracy of the control amount θ*c* can be improved by repeating the second target degree of throttle opening θ2 at the two points.

Further, since there is the delay of about 200 msec. until the air sucked into the engine is made to the actual torque output and the engine is controlled in an average amount of air with respect to the pulsation of an air flow which is one half or less the delay time, the affect due to the pulsation can be suppressed to almost zero.

Thus, since operation can be carried out so that the average value of the second target degree of throttle opening θ2 in a given period of time is made to the first target degree of throttle opening θ1, the object can be securely achieved.

With this operation, the amount of intake air Q*a* can be controlled with a pinpoint accuracy in the various types of the predetermined operating states such as the idle operating state, the wheel slip state, the constant speed traveling state, the first idle operating state and so on.

What is claimed is:

1. An engine controller, comprising:

a throttle actuator for electrically regulating a degree of throttle opening for determining the amount of intake air of an engine;

various sensors for detecting the operating states of the engine including the degree of throttle opening and a degree of accelerator opening; and a throttle control unit for determining the control amount of said throttle actuator based on the operating states, wherein, said throttle control unit, comprising:

an A/D converter for converting the degree of throttle opening and the degree of accelerator opening into digital signals at a predetermined resolving power;

first calculation means for calculating a first target degree of throttle opening at a first resolving power higher than the predetermined resolving power;

second calculation means for calculating a second target degree of throttle opening at a second resolving power equal to the predetermined resolving power in accordance with the first target degree of throttle opening; and control amount calculation means for calculating the control amount in accordance with the operating states and the first and second target degrees of throttle opening, the second target degree of throttle opening includes two points determined at the second resolving power; and said control amount calculation means repeatedly controls said throttle actuator at a predetermined cycle using the second target degree of throttle opening as the control amount when the operating states satisfy predetermined conditions.

2. An engine controller according to claim 1, wherein when the first target degree of throttle opening is not equal to the second target degree of throttle opening, said control amount calculation means repeats the control amount at the two points which are located across the first target degree of throttle opening and determined at the second resolving power at a predetermined cycle.

3. An engine controller according to claim 1, wherein when the first target degree of throttle opening is equal to the second target degree of throttle opening, said control amount calculation means repeats the control amount at the two points which are located across the first target degree of throttle opening and determined by the second resolving power at a predetermined cycle.

4. An engine controller according to claim 1, wherein when the first target degree of throttle opening is equal to the second target degree of throttle opening, said control amount calculation means prohibits the repetition of the control and causes the control amount to coincide with the first target degree of throttle opening.

5. An engine controller according to claim 1, wherein the predetermined cycle is set longer than the response time of said throttle actuator as well as shorter than one half the delay time of the intake air of the engine.

6. An engine controller according to claim 2, wherein the ratio at which the control amount is repeated at the two points which are located across the first target degree of throttle opening in accordance with the second target degree of throttle opening is set by the function of the remainder obtained by subtracting the second target degree of throttle opening from the first target degree of throttle opening.

7. An engine controller according to claim 3, wherein the ratio at which the control amount is repeated at the two points across the first target degree of throttle opening in accordance with the second target degree of throttle opening is set to 1:1.

8. An engine controller according to claim 1, wherein:

said throttle control unit includes operating state discrimination means for discriminating an ordinary operating state and predetermined operating states in accordance with the above operating states;

said first calculation means prohibits the calculation of the first target degree of throttle opening when the ordinary operating state is discriminated and calculates the first target degree of throttle opening in accordance with the degree of accelerator opening when the predetermined operating states are discriminated; and said second calculation means calculates the second target degree of throttle opening in accordance with the degree of accelerator opening when the ordinary operating state is discriminated and calculates the second target degree of throttle opening in accordance with the first target degree of throttle opening when the predetermined operating states are discriminated.

9. An engine controller according to claim 8, wherein said various sensors include idle detection means and said operating state discrimination means discriminates an idle operating state based on a detection signal from said idle detection means as one of the predetermined operating states.

10. An engine controller according to claim 8, wherein said various sensors include wheel slip detection means and said operating state discrimination means discriminates a wheel slip state based on a detection signal from said idle detection means as one of the predetermined operating states.

11. An engine controller according to claim 8, wherein said various sensors include constant speed travel detection means and said operating state discrimination means discriminates a constant speed traveling state based on a detection signal from said idle detection means as one of the predetermined operating states.

12. An engine controller according to claim 8, wherein said various sensors include first idle detection means and said operating state discrimination means discriminates a first idle operating state based on a detection signal from said idle detection means as one of the predetermined operating states.

* * * * *